United States Patent [19]

Mehta et al.

[11] 4,355,101

[45] Oct. 19, 1982

[54] PHENYLMERCAPTOAZOLE COMPOUNDS

[75] Inventors: Avinash C. Mehta, Belmont; George H. Nawn, Westwood; Lloyd D. Taylor, Lexington, all of Mass.

[73] Assignee: Polaroid Corporation, Cambridge, Mass.

[21] Appl. No.: 222,542

[22] Filed: Jan. 5, 1981

[51] Int. Cl.[3] ..... G03C 5/54; G03C 1/06

[52] U.S. Cl. ..... 430/564; 430/219; 430/505; 430/957

[58] Field of Search ..... 430/214, 218, 219, 233, 430/600, 611, 603, 612, 613, 955, 957, 959, 960, 382, 505, 544, 564

[56] References Cited

U.S. PATENT DOCUMENTS

| | | | |
|---|---|---|---|
| 2,725,290 | 11/1955 | Smith . | |
| 3,260,597 | 7/1966 | Weyerts et al. . | |
| 3,265,498 | 8/1966 | Rogers et al. . | |
| 3,295,976 | 1/1967 | Abbott et al. . | |
| 3,377,166 | 4/1968 | Weyerts et al. . | |
| 3,698,898 | 10/1972 | Grasshoff et al. . | |
| 3,700,457 | 10/1972 | Youngquist | 430/957 |
| 3,708,303 | 1/1973 | Salesin | 430/949 |
| 4,009,029 | 2/1977 | Hammond et al. . | |
| 4,052,213 | 10/1977 | Credner et al. | 430/382 |
| 4,131,467 | 12/1978 | Bigelow . | |
| 4,286,054 | 8/1981 | Engelmann et al. | 430/553 |

FOREIGN PATENT DOCUMENTS 2427813 12/1974 Fed. Rep. of Germany .

OTHER PUBLICATIONS

Research Disclosure, Jul. 1974, p. 12, Abstr. No. 12319.

*Primary Examiner*—Mary F. Downey
*Attorney, Agent, or Firm*—Gaetano D. Maccarone

[57] ABSTRACT

Novel compounds which are represented by the formula

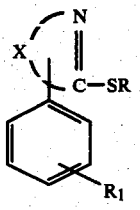

wherein X represents the nonmetallic atoms necessary to form a nucleus which completes a 5- or 6-membered heterocyclic moiety, R is a group which is cleavable in aqueous alkaline medium and $R_1$ is either a group which has a pKa of from about 7 to about 14 which is ionizable to an anion and wherein the silver salt of the mercaptan resulting from cleavage of –SR is rendered more soluble in the pH range within which $R_1$ is ionized to an anion than it is below that pH range or a precursor of such a group. The compounds are useful in photographic applications.

5 Claims, No Drawings

PHENYLMERCAPTOAZOLE COMPOUNDS

BACKGROUND OF THE INVENTION

This application relates generally to novel compounds and, more specifically, to blocked substituted phenylmercaptoazole compounds which are useful in photography.

Diffusion transfer photographic systems wherein images are formed in color by the use of image dye-providing materials such as dye developers are well known in the art. Generally, multicolor transfer images are formed by processing an exposed multicolor photosensitive silver halide element with an aqueous alkaline processing composition distributed between two sheet-like elements, one of these elements including an image receiving layer. The processing composition is so applied and confined within and between the two sheet-like elements as not to contact or wet outer surfaces of the two superposed elements, thus providing a film unit whose external surfaces are dry. The processing composition preferably is distributed in viscous form from a pressure rupturable container.

It is known in the art to carry out development in the presence of development restrainers whereby development of exposed silver halide is continued for a period of time sufficient to form an imagewise distribution of diffusible unoxidized dye developers in undeveloped areas of the silver halide emulsion layer(s) with the unoxidized dye developers being transferred by diffusion to a superposed image receiving element and, after the predetermined development period, restraining further development of exposed silver halide by means of the development restrainer. See, for example, U.S. Pat. No. 3,265,498. Various development restrainers which are useful for such purposes are known including mercaptoazoles such as 1-phenyl-5-mercaptotetrazole. However, the use of such development restrainers is subject to certain limitations. For example, U.S. Pat. No. 3,260,597 discloses that mercaptoazole development restrainers or "arrestors," such as 1-phenyl-5-mercaptotetrazole, can not be used in the aqueous alkaline processing composition in any appreciable amount because development of exposed silver halide will be stopped prematurely particularly in the outer blue and green sensitive emulsion layers of a multicolor system.

It is also known in the art to use blocked development restrainers which are designed to provide a timed release of a development restrainer during the development process. See, for example, U.S. Pat. No. 3,698,898 which discloses the use of quinone- or naphthoquinone-methide precursors which release a photographic reagent such as 1-phenyl-5-mercaptotetrazole in the presence of alkali; U.S. Pat. No. 4,009,029 which discloses a class of cyanoethyl-containing blocked development restrainers; German Offenlegungschrift No. 2,427,183 which discloses various blocked development restrainers, and U.S. Pat. Nos. 3,260,597 and 3,265,498, referred to above, which disclose hydrolyzable blocked restrainers.

The use of phenylmercaptotetrazole compounds which are substituted on the phenyl ring as development inhibitors in certain conventional photographic systems is also known. See, for example, Research Disclosure, July 1974, page 12, and U.S. Pat. No. 3,295,976.

SUMMARY OF THE INVENTION

The present application relates to novel blocked phenylmercaptoazole compounds which are substituted on the phenyl ring.

It is therefore an object of this invention to provide novel compounds.

It is another object to provide novel blocked phenylmercaptoazole compounds which are substituted on the phenyl ring.

It is a further object to provide such compounds which are useful in photographic applications.

It is still another object to provide compounds which allow controlled release of a photographically useful material during processing of a photographic element.

A further object is to provide photographic products and processes utilizing such compounds.

Another object is to provide diffusion transfer photographic products and processes utilizing such compounds.

BRIEF SUMMARY OF THE INVENTION

These and other objects and advantages are accomplished in accordance with the invention by providing novel compounds which are represented by the formula

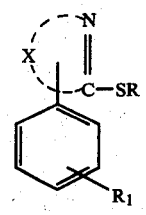

wherein X represents the nonmetallic atoms necessary to form a nucleus which completes a 5- or 6-membered heterocyclic moiety; R is a group which is cleavable in aqueous alkaline medium and $R_1$ is either a group which has a pKa of from about 7 to about 14 which is ionizable to an anion and wherein the silver salt of the mercaptan resulting from cleavage of -SR is rendered more soluble in the pH range within which $R_1$ is ionized to an anion than it is below that pH range, or a precursor thereof.

The compounds of the invention are generally phenylmercaptoazoles wherein the substituted phenyl moiety is attached to either a nitrogen atom or a carbon atom of the azole moiety. The heterocyclic moieties formed by X preferably include those wherein the heterocyclic atoms (i.e., atoms other than carbon) are members of a single heterocyclic ring as contrasted with compounds containing fused or condensed heterocyclic rings in which the heterocyclic atoms are members of more than one heterocyclic ring. Typical suitable compounds include monoazoles such as benzoxazoles, benzothiazoles, etc., diazoles such as benzimidazoles; triazoles such as 1,2,4-triazoles, etc.; tetrazoles and pryimidines. In a preferred embodiment of the invention the compounds include a tetrazole nucleus. The substituent ($R_1$) on the phenyl moiety may be either any suitable substituent which has a pKa of from about 7 to about 14 which is ionizable to an anion whereby the silver salt of the mercaptan (resulting from cleavage of —SR) is rendered more soluble in the pH range within which $R_1$ is ionized to an anion that it is below that pH range, or a precursor of such a substituent. Typical suitable substituents are:

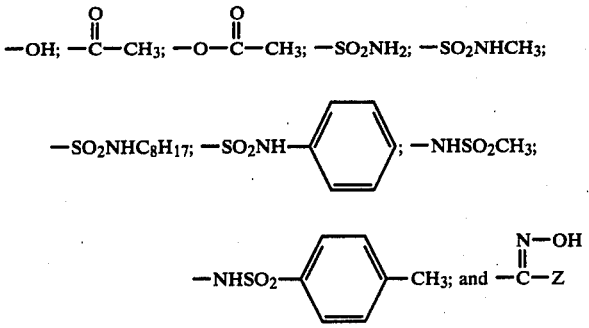

where Z is H, alkyl having from 1 to 10 carbon atoms, aralkyl such as benzyl or phenethyl, phenyl or substituted phenyl.

The blocking group R which is attached to the sulfur atom is designed to cleave from the molecule in an aqueous alkaline medium to provide a timed release of the desired substituted phenylmercaptoazole compound. The blocking group R may be any suitable blocking group such as, for example, those which cleave by hydrolysis; those which cleave by quinone methide elimination

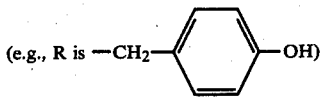

such as disclosed in U.S. Pat. No. 3,698,898; those which cleave by hydrolysis followed by quinone methide elimination

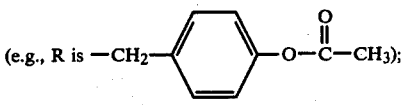

and those which cleave by $\beta$-elimination

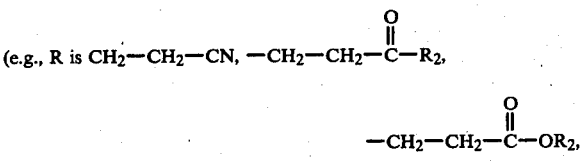

where $R_2$ is alkyl, and

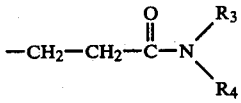

where $R_3$ and $R_4$ are H or alkyl). Typical suitable blocking groups include, for example,

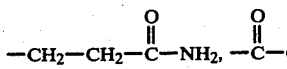

-continued

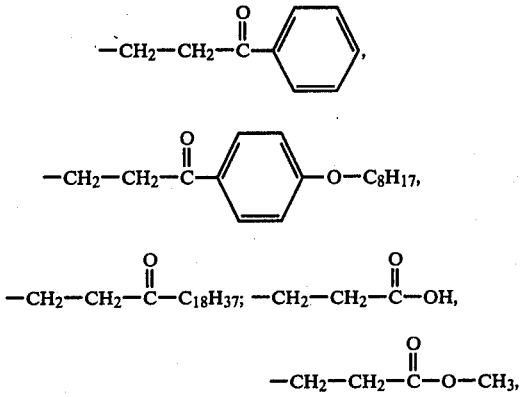

and succinimido groups which are substituted on the nitrogen atom with alkyl or aryl such as are described in U.S. Pat. No. 3,888,677.

In one embodiment of the invention, R is $—CH_2—CH_2SO_2R_5$ where $R_5$ is alkyl, aryl or substituted aryl. Novel sulfone compounds within Formula A wherein R is $—CH_2—CH_2SO_2R_5$ and their use in photographic applications are disclosed and claimed in copending patent application of James R. Bartels-Keith and Alan L. Borror Ser. No. 222,504, filed on even data herewith.

Cleavage of the blocking group in aqueous alkaline medium releases, in a timed fashion during development, the substituted phenylmercaptoazole moiety. Cleavage of the blocking group occurs according to the following reaction sequence:

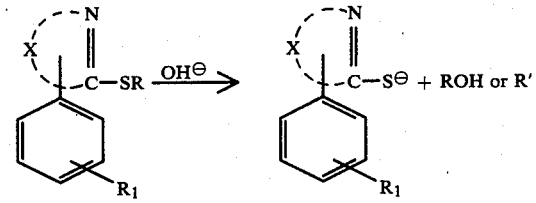

where R′ is R minus a proton.

The rate of release of the substituted phenylmercaptoazole moiety is dependent upon the hydroxyl ion concentration of the processing composition used to process the photographic elements in which the compounds are incorporated. The rate of release of the substituted phenylmercaptoazole moiety is also temperature dependent, that is, more is released as the temperature at which processing of the film unit is effected rises. Thus, more of the substituted phenylmercaptoazole moiety is made available at elevated temperatures, i.e., above room temperature, where more is typically desired, less is released at room temperature and even less below room temperature where lesser amount are needed. Thus, these blocked compounds which are utilized according to the invention provide more uniform sensitometry for the film units of the invention over a wide temperature range of processing. In other words, the sensitometry of the film units which include such blocked compounds according to the invention is less temperature dependent than would otherwise be the case.

In a preferred embodiment the compounds of the invention are utilized in diffusion transfer photographic products and processes. In such products and processes these compounds are useful to modify and/or control the sensitometry during diffusion transfer processing of an exposed photosensitive element particularly when such processing is carried out at elevated temperatures, e.g., at about 95° F. Such modification and/or control provides desirable results including a speed increase for one or more of the silver halide emulsions in a multicolor diffusion transfer photographic system and/or an increase in the Dmax of one or more of the individual colors due to control of fog development as will be discussed in detail below herein.

The advantageous results obtained through the use of the novel mercaptoazole compounds of the invention are not completely understood. However, to further aid those skilled in the art to understand and practice the invention, the proposed theoretical mechanism by which the advantageous results are thought to be effected will be discussed here. It should be understood, however, that the compounds and photographic products and processes of the invention have been proved to be operative and highly effective through extensive experimentation and the proposed theoretical mechanism is not to be construed as being limiting of the invention. It is theorized that the results obtained according to the invention are due to the ability of the substituted phenylmercaptazole moiety which is released during processing to perform different functions at different stages of the development process, that is, as weak silver solvents and promoters of development at one stage of the development process and as development inhibitors, or restrainers, at another stage of the development process, and that the dual functions of these photographically useful materials within the diffusion transfer photographic process are pH dependent.

It is well known that in the diffusion transfer photographic development process the pH of any particular location within the film unit varies with time. Typically, the processing composition employed in the process has a very high pH, e.g., from about 13–14, and during the development process each layer of the multilayer film unit goes through a broad pH range which includes very high pH levels and relatively low pH levels. When the pH is substantially equal to or above the pKa of the substituent $R_1$ on the phenyl ring, the dianion is formed, for example,

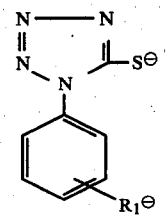

and acts as a weak silver solvent to form relatively soluble silver salts, thus promoting development. When the pH falls below the pKa of the substituent $R_1$, the monoanion is formed, for example,

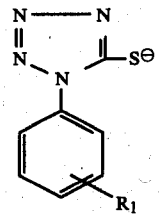

and the silver salt of the monoanion of the compound is very low in solubility resulting in a development restrainer action.

In the instances where certain substituted phenylmercaptotetrazole compounds were taught for use in specified photographic applications, i.e., the Research Disclosure article and U.S. Pat. No. 3,295,976, previously cited, the processes do not involve different pH at different stages of the development process. Thus, the pH-dependent dual functions of these compounds were not known or utilized in the processes disclosed in these references.

In view of the foregoing disclosure it will be understood by those skilled in the art that according to a preferred diffusion transfer photographic process of the invention, development of the exposed photosensitive element is carried out with a processing composition having an initial pH substantially equal to or above the pKa of $R_1$, at least for some period of time after the processing composition comes into contact with the blocked mercaptoazole compound so as to enable the substituent to ionize to form the dianion. In addition, at some point during the development process the pH of the environment where the compound is located is reduced below the pKa of $R_1$ so as to form the monoanion.

DESCRIPTION OF THE PREFERRED EMBODIMENTS

The preferred compounds of the invention are represented by the formulas

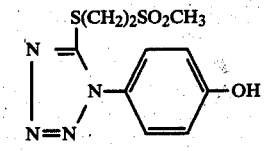

(I)

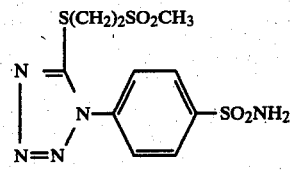

(II)

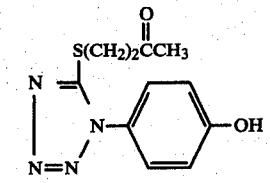

(III)

-continued (IV)

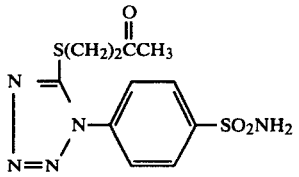

(V)

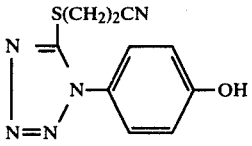

(VI)

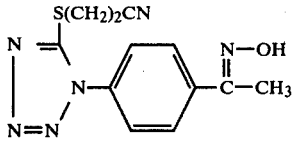

(VII)

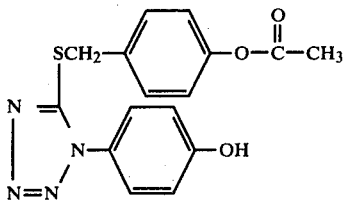

(VIII)

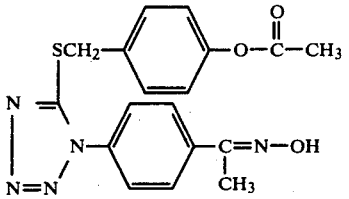

The mercaptoazole compounds which are useful according to the invention may be prepared by reactions which are well known in the art. For example, 2-mercaptoimidazoles can be prepared by the reactions disclosed in The Chemistry of Heterocyclic Compounds Vol. 6: Imidazole and Its Derivatives, Part I, Hofmann, Interscience Publishers, Inc., New York, 1953, pages 77–85; Mercaptothiazoles and mercaptobenzothiazoles can be prepared according to the methods disclosed in The Chemistry of Heterocyclic Compounds, Vol. 34: Thiazole and Its Derivatives, Part I, Metzger, John Wiley and Sons, 1979, pages 260–269; Part 2, pages 370–377; benzoxazolethiones can be prepared according to the methods disclosed in Heterocyclic Compounds, Vol. 5, Elderfield, John Wiley and Sons, 1957, pages 439–444; 5-mercapto-1,3,4-oxadiazoles can be prepared according to the methods disclosed in Heterocyclic Compounds, Vol. 7, Elderfield, John Wiley and Sons, 1961, page 352; mercapto-1,3,4-thiadiazoles, ibid, pages 587–612; and tetrazoles by the techniques disclosed in Heterocyclic Compounds, Vol. 8, Elderfield, John Wiley and Sons, 1967, pages 1–107. Mercapto-1,2,4-triazoles can be prepared by known literature techniques as described, for example, in Jour. Chem. Soc.; E. Haggarth 1163 (1949). The blocking group can be attached to the substituted phenylmercaptoazole moiety by known reactions such as by preforming the monosodium salt of the appropriate mercaptoazole derivative and carrying out a condensation reaction with the appropriate blocking group in a solvent such as acetone, ethanol, acetonitrile, etc., or by reacting the mercaptoazole derivative with the appropriate blocking group in a suitable solvent in the presence of one equivalent of sodium bicarbonate. Alternatively, the appropriate mercaptoazole derivative can be formed and the blocking group attached by means of a Michael addition with an appropriate olefin such as $CH_2{=}CH{-}Y$ where Y is an electron withdrawing group such as cyano, etc., according to known teachings in the art.

The preparation of 1-(4-hydroxy)phenylmercaptotetrazole is described in *Pharmazie,* 29(2), 1974, pages 95–99. The preparation of 1-(4-sulfonamide)phenylmercaptotetrazole is described in Khim. Geterotsikl.Soedin, Sb.l: Azotsoderghashchie Geterotsikl, 1967, pages 199–201.

The compounds within generic formula A wherein $R_2$ is

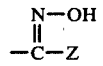

are disclosed and claimed in our copending patent application Ser. No. 222,543, filed on even date herewith. The novel compounds of the invention are useful in the diffusion transfer photographic products and processes disclosed and claimed in our copending patent application Ser. No. 222,502, filed on even date herewith.

As stated previously, $R_1$ may also be a precursor of a substituent which has the requisite properties and the desired substituent may be formed in situ. For example, where it is desired to develop the exposed photosensitive element in the presence of a compound within Formula A which has a hydroxy group on the phenyl ring, it is possible to incorporate in the film unit as a precursor a compound within Formula A which has hydrolyzable ester group on the phenyl ring and generate the desired hydroxy group in situ during photographic processing.

It should be noted here that the acetyl group which can be substituted on the phenyl ring does not ionize to any appreciable extent to form an anion in an aqueous alkaline photographic processing composition. However, it has been shown by experimentation that incorporating in a diffusion transfer film unit, an unblocked phenylmercaptotetrazole compound having an acetyl group in the para position on the phenyl ring, will provide advantageous results. Thus, it would appear that the compound undergoes a change in aqueous alkaline processing composition and that the acetyl substituent is a precursor of a group which has the requisite properties described above which provide the desired results.

Table I lists the pKa of various substituents on the phenyl ring as measured for unblocked phenylmercaptotetrazole compounds.

TABLE I

| SUBSTITUENT | pKa |
|---|---|
| (p) $-OH$ | 10.10 ± 0.1 |
| (p) $-C(=N-OH)-CH_3$ | 11.4 |
| (o) $-OH$ | 9.50 ± 0.1 |
| (p) $-SO_2NH_2$ | 9.95 ± 0.1 |
| (p) $-SO_2NHCH_3$ | 11.55 ± 0.1 |

TABLE I-continued

| SUBSTITUENT | pKa |
|---|---|
| (p) $-SO_2NH-$ 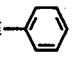 | 9.55 ± 0.1 |
| (p) $-NHSO_2CH_3$ | 8.65 ± 0.1 |
| (p) $-NHSO_2-$ 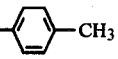 $-CH_3$ | 8.80 ± 0.1 |

Solubility product measurements were made for the silver salt of phenylmercaptotetrazole (PMT) at pH 13.5 and for the silver salt of a compound represented by the formula

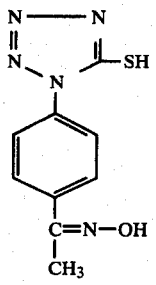

IX at pH 7 and pH 13.5 (above and below the pKa of the oxime substituent. The results are listed in Table II.

TABLE II

| COMPOUND | pH | Ksp |
|---|---|---|
| PMT | 7 | $3 \times 10^{-16}$* |
| | 13.5 | $4 \times 10^{-16}$ |
| | 7 | $\sim 1 \times 10^{-16}$ |
| IX | 13.5 | $2 \times 10^{-15}$ |

*Z.C.H. Tan, Photogr. Sci. Eng. 19, 17 (1975)

It is seen that while phenylmercaptotetrazole was relatively unaffected by pH the ionization of the oxime subsubstituent increased the solubility of the silver salt of the compound VIII by an order of magnitude.

The solubilities of the silver salts of PMT and compound VIII in the presence of excess amounts of their anions were measured at pH 7.0 and 13.5. Each solution was $4 \times 10^{-3}$ molar in silver. The results are shown in Table III wherein the solubility data is expressed in $\mu$ moles/liter of total silver.

TABLE III

| Molar Ratio Compound/Ag | COMPOUND VIII pH | | PMT pH | |
|---|---|---|---|---|
| | 7.0 | 13.5 | 7.0 | 13.5 |
| 1.25/1 | <1 | 19 | <1 | 1 |
| 1.75/1 | <1 | 44 | <1 | 2 |
| 2.13/1 | <1 | 93 | 1 | 4 |
| 2.5/1 | 2 | 140 | 3 | 8 |
| 4.5/1 | 2 | 320 | 15 | 18 |
| 7.5/1 | 5 | 1400 | 58 | 63 |

It can be seen that compound VIII is a weak to moderate silver solvent at high pH while PMT is not. Further, it is evident that when the oxime substituent is protonated it reverts to behavior which is similar to that of PMT. In fact, compound VIII forms an even less soluble salt in neutral solution than does PMT, thus giving it greater differentiation on the availability of silver in soluble form as the pH drops in the diffusion transfer development process.

The compounds of the invention are useful generally in any photographic element wherein a development restrainer is desirable. By incorporating the compounds in a phtographic element which is processed with an aqueous alkaline processing composition having a pH less than the pKa of the substituent $R_1$ on the phenyl ring, the development restrainer action of the silver salt of the monoanion of the compound can be exploited.

The compounds may be incorporated in any location within a photosensitive element with the preferred location being dependent upon various factors such as the compound itself, the type of element and the results desired. Of course, it is apparent that these blocked materials are not incorporated in the processing composition. The compounds may be incorporated in a film unit in any useful amount. Routine scoping tests may be used to ascertain the concentration appropriate for any given film unit and location.

In a preferred embodiment of the invention compounds according to the invention can be incorporated in more than one location in a photosensitive element. In a preferred diffusion transfer photographic system according to the invention, a blocked compound according to the invention is incorporated in at least one location in the photosensitive element and an unblocked substituted phenylmercaptoazole compound is incorporated in the processing composition. Thus during the initial stages of development the quantity of unblocked compound available can be appropriate to provide a speed increase for one or more silver halide emulsions (silver solvent effect) without providing any undesired premature development restraint and the additional quantity dissolved during processing (from the blocked compound) could give a total concentration desired to prevent further development.

In another preferred diffusion transfer photosensitive element a blocked compound of the invention is incorporated in a layer between the support and the silver halide emulsion closets to the support. This embodiment provides a delay in the cleavage of the blocking group and a delay in the diffusion of the substituted phenylmercaptoazole moiety through the film unit.

The compounds used in accordance with the invention may be used generally in association with any silver halide emulsion. It is preferred to use the compounds in a diffusion transfer photographic system which includes a negative silver halide emulsion, i.e., one hich develops in the areas of exposure. The diffusion transfer photographic system of the invention may include any image dye-providing material in association with the silver halide emulsion(s).

The image dye-providing materials which can be utilized generally may be characterized as either (1) initially soluble or diffusible in the processing composition but which are selectively rendered nondiffusible imagewise as a function of development; or (2) initially insoluble on nondiffusible in the processing composition but which selectively provide a diffusible product imagewise as a function of development. The image dye-providing materials may be complete dyes or dye intermediates, e.g., color couplers. The requisite differential in mobility or solubility may be obtained, for example, by a chemical reaction such as a redox reaction, a coupling reaction or a cleavage reaction. In a particularly preferred embodiment of the invention the image dye-providing materials are dye developers which are initially diffusible materials. The dye developers contain, in the same molecule, both the chromophoric system of a dye and a silver halide developing function as is described in U.S. Pat. No. 2,983,606. Other image dye-providing materials which may be used include, for example, initially diffusible coupling dyes such as are useful in the diffusion transfer process described in U.S. Pat. No. 3,087,817 and which are rendered nondiffusible by coupling with the oxidation product of a color developer; initially nondiffusible dyes which release a diffusible dye following oxidation, sometimes referred to as "redox dye releaser" dyes, such as described in U.S. Pat. Nos. 3,725,062 and 4,076,529; initially nondiffusible image dye-providing materials which release a diffusible dye following oxidation and intramolecular ring closures as are described in U.S. Pat. No. 3,433,939 or undergo silver assisted cleavage to release a diffusible dye in accordance with the disclosure of U.S. Pat. No. 3,719,489; and initially nondiffusible image dye-providing materials which release a diffusible dye following coupling with an oxidized color developer as described in U.S. Pat. No. 3,227,550.

The compounds may be incorporated into the photographic elements by any suitable technique. In embodiments where the compounds are incorporated in a separate discrete layer or in a layer of the film unit they are typically coated from a water or oil dispersion and the layer includes a binder material such as gelatin or the like.

The diffusion transfer film units of the invention include those wherein the image receiving element is designed to be separated from the photosensitive element after processing and integral positive-negative diffusion transfer film units which are retained intact after processing. In a preferred embodiment the diffusion transfer film units of the invention utilize initially diffusible dye developers as the image dye-providing materials. As described in U.S. Pat. No. 2,983,606, a photosensitive element containing a dye developer and a silver halide emulsion is photoexposed and a processing composition applied thereto, for example, by immersion, coating, spraying, flowing, etc., in the dark. The exposed photosensitive element is superposed prior to, during, or after the processing composition is applied, on a sheet-like support element which may be utilized as an image-receiving element. In a preferred embodiment, the processing composition is applied to the exposed photosensitive element in a substantially uniform layer as the photosensitive element is brought into superposed relationship with the image-receiving layer. The processing composition, positioned intermediate the photosensitive element and the image-receiving layer, permeates the emulsion to initiate development of the latent image contained therein. The dye developer is immobilized or precipitated in exposed areas as a consequence of the development of the latent image. This immobilization is apparently, at least in part, due to a change in the solubility characteristics of the dye developer upon oxidation and especially as regards its solubility in alkaline solutions. It may also be due in part to a tanning effect on the emulsion by oxidized developing agent, and in part to a localized exhaustion of alkali as a result of development. In unexposed and partially exposed areas of the emulsion, the dye developer is unreacted and fiffusible and thus provides an imagewise distribution of unoxidized dye developer, diffusible in the processing composition, as a function of the point-to-point degree of exposure of the silver halide emulsion. At least part of this imagewise distribution of unoxidized dye developer is transferred, by imbibition, to a superposed image-receiving layer or element, said transfer substantially excluding oxidized dye developer. The image-receiving layer receives a depthwise diffusion, from the developed emulsion, of unoxidized dye developer without appreciably disturbing the imagewise distribution thereof to provide a reversed or positive color image of the developed image. The image-receiving element may contain agents adapted to mordant or otherwise fix the diffused, unoxidized dye developer. In a preferred embodiment of said U.S. Pat. No. 2,983,606 and in certain commercial applications thereof, the desired positive image is revealed by separating the image-receiving layer from the photosensitive element at the end of a suitable imbibition period. Alternatively, as also disclosed in said U.S. Pat. No. 2,983,606, the image-receiving layer need not be separated from its superposed contact with the photosensitive element, subsequent to transfer image formation, if the support for the image-receiving layer, as well as any other layers intermedite said support and image-receiving layer, is transparent and a processing composition containing a substance, e.g., a white pigment, effective to mask the developed silver halide emulsion or emulsions is applied between the image-receiving layer and said silver halide emulsion or emulsions.

Dye developers, as noted in said U.S. Pat. No. 2,983,606, are compounds which contain, in the same molecule, both the chromophoric system of a dye and also a silver halide developing function. By "a silver halide developing function" is meant a grouping adapted to develop exposed silver halide. A preferred silver halide development function is a hydroquinonyl group. In general, the development function includes a benzenoid developing function, that is, an aromatic developing group which forms quinonoid or quinone substances when oxidized.

Multicolor images may be obtained using dye developers in diffusion transfer processes by several techniques. One such technique contemplates obtaining multicolor transfer images utilizing dye developers by employment of an integral multilayer photosensitive element, such as is disclosed in the aforementioned U.S. Pat. No. 2,983,606 and in U.S. Pat. No. 3,345,163, wherein at least two selectively sensitized photosensitive strata, superposed on a single support, are processed, simultaneously and without separation, with a single common image-receiving layer. A suitable arrangement of this type comprises a support carrying a red-sensitive silver halide emulsion stratum, a green-sensitive silver halide emulsion stratum and a blue-sensitive silver halide emulsion stratum, said emulsions having associated therewith, respectively, for example, a cyan dye developer, a magenta dye developer and a yellow dye developer. The dye developer may be utilized in the silver halide emulsion stratum, for example in the form of particles, or it may be disposed in a stratum behind the appropriate silver halide emulsion strata. Each set of silver halide emulsion and associated dye developer stata may be separated from other sets by suitable interlayers, for example, by a layer or stratum of gelatin or polyvinyl alcohol. In certain instances, it may be desirable to incorporate a yellow filter in front of the green-sensitive emulsion and such yellow filter may be incorporated in an interlayer. However, where desirable, a yellow dye developer of the appropriate spectral characteristics and present in a state capable of functioning as a yellow filter may be so employed and a separate yellow filter omitted.

Particularly useful products for obtaining multicolor dye developer images are disclosed in U.S. Patent No. 3,415,644. This patent discloses photographic products wherein a photosensitive element and an image-receiving element are maintained in fixed relationship prior to exposure, and this relationship is maintained as a laminate after processing and image formation. In these products, the final image is viewed through a transparent (support) element against a light-reflecting, i.e., white background. Photoexposure is made through said transparent element and application of the processing composition provides a layer of light-reflecting material to provide a white background. The light-reflecting material (referred to in said patent as an "opacifying agent") is preferably titanium dioxide, and it also performs an opacifying function, i.e., it is effective to mask the developed silver halide emulsions so that the transfer image may be viewed without interference therefrom, and it also acts to protect the photoexposed silver halide emulsions from postexposure fogging by light passing through said transparent layer if the photoexposed film is removed from the camera before image-formation is completed.

U.S. Pat. No. 3,647,437 is concerned with improvements in products and processes disclosed in said U.S. Pat. No. 3,415,644, and discloses the provision of light-absorbing materials to permit such processes to be performed, outside of the camera in which photoexposure is effected, under much more intense ambient light conditions. A light-absorbing material or reagent, preferably a pH-sensitive phthalein dye, is provided so positioned and/or constituted as not to interfere with photoexposure but so positioned between the photoexposed silver halide emulsions and the transparent support during processing after photoexposure as to absorb light which otherwise might fog the photoexposed emulsions. Furthermore, the light-absorbing material is so positioned and/or constituted after processing as not to interfere with viewing the desired image shortly after said image has been formed. In the preferred embodiments, the light-absorbing material, also sometimes referred to as an optical filter agent, is initially contained in the processing composition together with a light-reflecting material, e.g., titanium dioxide. The concentration of the light-absorbing dye is selected to provide the light transmission opacity required to perform the particular process under the selected light conditions.

In a particularly useful embodiment, the light-absorbing dye is highly colored at the pH of the processing composition, e.g., 13–14, but is substantially non-absorbing of visible light at a lower pH, e.g., less than 10–12. This pH reduction may be effected by an acid-reacting reagent appropriately positioned in the film unit, e.g., in a layer between the transparent support and the image-receiving layer.

The dye developers are preferably selected for their ability to provide colors that are useful in carrying out subtractive color photography, that is, the previously mentioned cyan, magenta and yellow. The dye developers employed may be incorporated in the respective silver halide emulsion or, in the preferred embodiment, in a separate layer behind the respective silver halide emulsion, and such a layer of dye developer may be applied by use of a coating solution containing the respective dye developer distributed, in a concentration calculated to give the desired coverage of dye developer per unit area, in a film-forming natural, or synthetic, polymer, for example, gelatin, polyvinyl alcohol, and the like, adapted to be permeated by the processing composition.

Other diffusion transfer products and processes according to the invention are the types described in U.S. Pat. Nos. 3,573,043 and 3,594,165. For convenience, the entire disclosure of each of the six patents referred to immediately above is hereby incorporated by reference herein.

A particularly useful diffusion transfer film unit according to the invention is one wherein the photosensitive element includes a light-reflecting layer between the silver halide layer and the image-dye providing layer (as described in Canadian Pat. No. 668,952), the substrate of the photosensitive element carries the polymeric acid neutralizing layer which in turn carries the timing layer (as described in U.S. Pat. No. 3,573,043) and the processing composition includes an oximated polydiacetone acrylamide thickening agent (as described in U.S. Pat. No. 4,202,694).

The invention will now be described further in detail with respect to specific preferred embodiments by way of examples, it being understood that these are illustrative only and the invention is not intended to be limited to the materials, conditions, process parameters, etc. which are recited therein. All parts and percentages are by weight unless otherwise indicated.

EXAMPLE I

Preparation of Compound I

A catalyst was prepared by stirring a mixture of Celite® (10 g.) (diatomaceous earth available from Johns Manville) and potassium fluoride dihydrate (15 g.) in 250 ml. of distilled water for 30 minutes. The water was removed by evaporation on a rotary evaporator and the solids dried overnight at room temperature under high vacuum. The catalyst was further dried in a vacuum over at 58°–60° C. for about two days.

To a stirred solution of 1-(4-hydroxyphenyl)-5-mercaptotetrazole (5 g.) in dry tetrahydrofuran (50 ml.) at room temperature under nitrogen there were added methylvinylsulfone (2.8 g.) and the potassium/Celite catalyst (1 g.). The reaction mixture was stirred slowly for 24 hours. The solids were removed by filtration and the solvent was removed from the filtrate on a rotary evaporator leaving behind a clear yellow-brown oil. The oil was dried under vacuum to give a tacky gum-like material. Recrystallization from methanol followed by drying to constant weight under vacuum gave a white, solid, compound I, m.p. 139°–141° C.

The NMR spectrum of the material was consistent with compound I. $^{13}C$ NMR (dmso-$d_6$); δ159.28, 153.69, 126.28, 124.05, 116.23, 53.01, 40.59, 25.29 ppm.

EXAMPLE II

Preparation of Compound II

To a suspension of 1-(4-sulfonamidophenyl)-5-mercaptotetrazole (2.166 g, 8.43 mmol) in methanol (10 ml) there were added, under nitrogen, 78% methyl vinyl sulfone (1.44 g, 8.42 mmol) and 0.25 ml of 40% benzyl trimethyl ammonium hydroxide in methanol and the reaction mixture refluxed for twenty four hours. The cooled reaction mixture was filtered to collect the white crystals which had formed. Thin layer chromatography showed that some starting materials were present. The desired product, compound II, was separated by column chromatography followed by removal of the solvent, crystallization on standing and drying. The structure of the product was confirmed by UV and $^{13}C$ NMR spectra.

EXAMPLE III

Preparation of Compound III

A catalyst was prepared by stirring a mixture of 10 g of Celite® (diatomaceous earth available from Johns Manville) and 15 g of potassium fluoride in 250 ml of distilled water for about 30 minutes, removing the water on a rotary evaporator at 56° C. and drying the solid under vacuum at 58°-60° C. to calculated weight, 19.6 g. The catalyst (1 g) was added to a stirred solution of 5 g of 1-(4-hydroxy-phenyl)-5-mercaptotetrazole and 1.8 g of methyl vinyl ketone in 50 ml of dry tetrahydrofuran and the suspension was stirred under nitrogen at room temperature for three days. The solids were removed by filtering and the solvent removed from the filtrate to give about 7 g of a brown-yellow oil which was stirred briefly with 70 ml of ether at room temperature. The ether solution was decanted from the brown oily solid which had deposited, and the crystalline solid which formed in the ether on standing collected by filtration, washed and dried to give 4 g of white crystals (compound III), m.p. 118°-120° C. The structure of the product was confirmed by a $^{13}C$ NMR spectrum.

EXAMPLE IV

Preparation of Compound IV

A mixture of compound 1-(4-sulfonamidophenyl)-5-mercaptotetrazole (257 mg., 1.0 mmol), methyl vinyl ketone (0.081 ml, 1.0 mmol) and 200 mg of potassium fluoride on Celite catalyst (6 mmol/g) in about 2 ml of pyridine was stirred overnight. The reaction mixture was poured into 5% hydrochloric acid and the solid collected by filtration. Thin layer chromatography showed two compounds. The desired product (compound XV) was separated by column chromatography, followed by removal of the solvent, crystallization on standing and drying. The structure of the product was confirmed by a proton NMR spectrum.

EXAMPLE V

Preparation of Compound V

A stirred mixture of 1-(4-hydroxyphenyl)-5-mercaptotetrazole (30.0 g, 0.154 m), 3-bromopropionitrile (20.72 g, 0.154 m) and sodium bicarbonate (12.98 g, 0154 m) in 600 ml of dry acetonitrile was heated under nitrogen at 55° C. for 42 hours, then cooled in an ice bath and vacuum filtered. The filtrate was evaporated on a rotary evaporator at 25° C. The syrupy residue was taken up in 500 ml of ethyl acetate, washed with 400 ml of saturated $NaHCO_3$ solution and twice with 200 ml of water, dried over sodium sulfate and adsorptive activated carbon, and vacuum filtered through diatomaceous earth. The filtrate was evaporated on a rotary evaporator at 25° C. and the crystalline residue was taken up in 200 ml of ethyl acetate and 100 ml of hexane added to the solution. The solution was stored in a refrigerator overnight and 50 ml of hexane added. The crystalline material was collected by filtration, washed with two 50 ml volumes of hexane and dried under reduced pressure at ambient temperature to give 25 g (65.7% yield) of compound V.

EXAMPLE VI

Preparation of Compound VI

A mixture of 1-(4-acetyloximephenyl)-5-mercaptotetrazole (11.647 g, 49.58 mmol), β-bromopropionitrile (6.626 g, 49.58 mmol) and sodium bicarbonate (4.17 g, 49.58 mmol) in 200 ml of dry acetonitrile was magnetically stirred in a 55° C. bath under nitrogen overnight. The reaction mixture was vacuum filtered and the filtrate was stripped of solvent by rotary evaporation giving an orange oily residue. The residue was taken up in ethyl acetate (75 ml) and to the solution there were added seed crystals and 150 ml of hexane. The mixture was scratched and stored overnight in a refrigerator. The crystals which formed were collected by filtration, washed twice with hexane and dried to give 12.74 g of compound VI as light yellow crystals, m.p. 111°-113° C. The structure of the product was confirmed by IR, UV and NMR spectra and thin layer chromatography.

EXAMPLE VII

Preparation of Compound VII

A mixture of compound 1-(4-hydroxyphenyl-5-mercaptotetrazole (4.14 g, 21.3 mmol), p-acetoxybenzyl chloride (3.94 g, 21.3 mmol) and sodium bicarbonate (1.79 g, 21.3 mmol) in 130 ml of dry acetonitrile was magnetically stirred under dry nitrogen at 55° C. overnight. The reaction mixture was cooled in an ice bath, the solids removed by vacuum filtration and the solvent stripped from the filtrate to give an oily residue. The oily residue was taken up in 100 ml. of ethyl acetate, washed with 80 ml of saturated sodium bicarbonate and twice with 80 ml of water, dried over sodium sulfate and activated charcoal and the mixture vacuum filtered through diatomaceous earth to give a light yellow solution. The solvent was stripped from the solution by rotary evaporation to give 12.5 g. of a light yellow oil. The oil was taken up in a mixture of 20 ml of ethyl acetate and 80 ml of hexane and the solution allowed to stand in a refrigerator overnight. The solvent was stripped by rotary evaporation to give an oily residue which was taken up in 100 ml of hexane and allowed to stand. The crystals which formed were collected by filtration, recrystallized from a mixture of 100 ml of hexane and 10 ml of ethyl acetate, washed with 20 ml of hexane and dried to give 6.17 g of the desired product (compound VII), m.p. 153°-154° (84.6% yield). The structure of the product was confirmed by IR, UV and NMR spectra and thin layer chromatography.

EXAMPLE VIII

As a control a film unit was prepared as follows: the negative element comprised an opaque subcoated polyethylene terephthalate film base on which the following layers were coated in succession.

1. as a polymeric acid layer approximately 9 parts of a ½ butyl ester of polyethylene/maleic anhydride copolymer and 1 part of polyvinyl butyral coated at a coverage of about 26,460 mgs./m.$^2$;

2. a timing layer comprising about 97% of a 60-29-6-4-0.4 pentapolymer of butylacrylate, diacetone acrylamide, methacrylic acid, styrene and acrylic acid and about 3% polyvinylalcohol coated at a coverage of about 3000 mgs./m.$^2$;

3. a cyan dye developer layer comprising about 511 mgs./m.$^2$ of a cyan dye developer represented by the formula

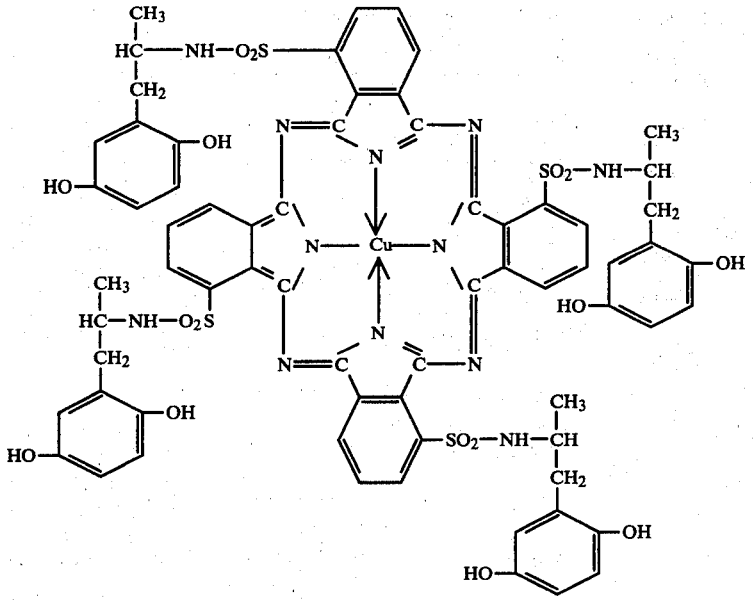

about 70 mgs./m.$^2$ of 4' methyl phenyl hydroquinone and about 317 mgs./m.$^2$ of gelatin;

4. a red-sensitive silver iodobromide emulsion layer comprising about 1378 mgs./m.$^2$ of silver and about 827 mgs./m.$^2$ of gelatin;

5. an interlayer comprising about 2090 mgs./m.$^2$ of the pentapolymer described in layer 2, about 110 mgs./m.$^2$ of polyacrylamide and about 44 mgs./m.$^2$ of succinaldehyde;

6. a magenta dye developer layer comprising about 460 mgs./m.$^2$ of a magenta dye developer represented by the formula

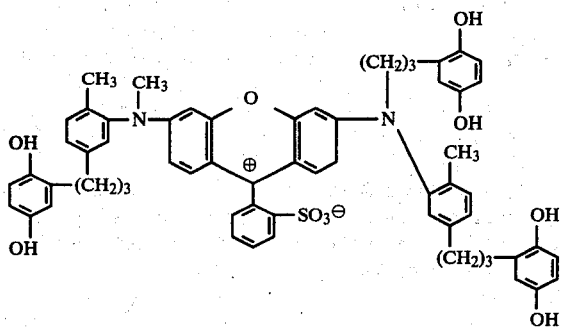

and about 210 mgs./m$^2$ of gelatin;

7. a green-sensitive silver iodobromide emulsion layer comprising about 723 mgs./m.$^2$ of silver and about 318 mgs./m.$^2$ of gelatin;

8. an interlayer comprising about 1881 mgs./m.$^2$ of the pentapolymer described in layer 2 and about 99 mgs./m.$^2$ of polyacrylamide;

9. a yellow dye developer layer comprising about 689 mgs./m.$^2$ of a yellow dye developer represented by the formula

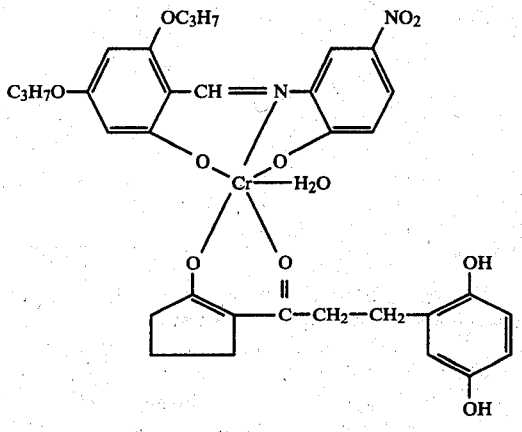

and about 276 mgs./m.$^2$ of gelatin;

10. a blue-sensitive silver iodobromide emulsion layer comprising about 764 mgs./m.$^2$ of silver, about 499 mgs./m.$^2$ of gelatin, and about 265 mgs./m.$^2$ of 4'-methyl phenyl hydroquinone;

and 11. a topcoat layer of about 400 mgs./m.$^2$ of gelatin.

The image receiving element comprised a transparent subcoated polyethylene terephthalate film base upon which there was coated an image receiving layer coated at a coverage of about 300 mgs./ft.$^2$ (3229 mgs./m$^2$) of: (a) 3 parts of a mixture of 2 parts polyvinyl alcohol and 1 part poly-4-vinylpyridine and (b) 1 part of a graft copolymer comprised of 4-vinylpyridine (4VP) and vinyl benzyl trimethyl ammonium chloride (TMQ) grafted onto hydroxyethyl cellulose (HEC) at a ratio HEC/4VP/TMQ of 2.2/2.2/1; and about 5 mgs./ft.$^2$ (53.8 mgs./m.$^2$) of 1,4-butanediol diglycidyl ether.

The film unit was processed with a processing composition made up as follows:

| | |
|---|---|
| Water | 1632 ml. |
| $TiO_2$ | 2312.0 grams |
| Oximated polydiacetoneacrylamide | 32.0 grams |

-continued

| | |
|---|---|
| Potassium hydroxide (45% solution) | 468.0 grams |
| Benzotriazole | 22.0 grams |
| 4-aminopyrazole-(3,4-d)pyrimidine | 10.0 grams |
| 6-methyl uracil | 12.0 grams |
| N—hydroxyethyl-N,N',N'—triscarboxymethyl ethylene diamine | 30.0 grams |
| Polyethylene glycol (M.W. 4000) | 18.0 grams |
| Bis(2-aminoethyl)sulfide | 0.8 grams |
| Colloidal silica (30% solids) | 37.0 grams |
| N—phenethyl-α-picolinium bromide (50% solids) | 102.0 grams |
| Allopurinol | 3.3 grams |
| 2-methyl imidazole | 23.8 grams |
| 6-methyl-5-bromo azabenzimidazole | 4.8 grams |
| 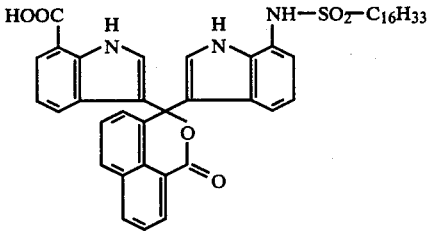 | 14.0 grams |
| 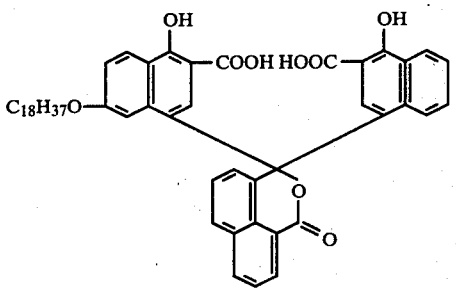 | 62.3 grams |

The negative element was exposed (2 meter-candle-seconds) on a sensitometer to a test exposure scale with white light, and then brought together with the image receiving element and processed at room temperature (24° C.) by passing the film unit through a pair of rollers set at a gap spacing of about 0.0026 inch. The film unit was kept intact and viewed through the base of the image receiving element.

An identical film unit was processed in the same manner at 35° C. The neutral density columns of the images were read on a densitometer to obtain the Dmax and Dmin values for red, green and blue, respectively. The values obtained are shown in Table IV.

Seven additional film units according to the invention (VIIIA–VIIIG) were prepared. These were identical to the control with the exception that the negatives also included a top coat layer comprising about 20 mg./ft.$^2$ (215 mgs./m.$^2$) of a blocked compound according to the invention (as shown in Table IV) and about 20 mg./ft.$^2$ of gelatin. The film units were processed as described above at 24° C. and at 35° C. The results are shown in Table IV.

TABLE IV

| Film Unit | Compound | 24° C. Dmax R | G | B | Dmin R | G | B |
|---|---|---|---|---|---|---|---|
| Control | | 1.81 | 1.60 | 1.31 | 0.15 | 0.16 | 0.24 |
| VIIIA | I | 1.60 | 1.48 | 1.40 | 0.18 | 0.17 | 0.24 |
| VIIIB | II | 1.33 | 1.43 | 1.41 | 0.15 | 0.16 | 0.23 |
| VIIIC | III | 1.68 | 1.74 | 1.91 | 0.16 | 0.17 | 0.26 |
| VIIID | IV | 1.44 | 1.39 | 1.37 | 0.16 | 0.13 | 0.16 |
| VIIIE | V | 1.30 | 1.42 | 1.46 | 0.15 | 0.13 | 0.15 |
| VIIIF | VI | 1.58 | 1.65 | 1.64 | 0.16 | 0.13 | 0.15 |
| VIIIG | VII | 1.48 | 1.83 | 1.88 | 0.14 | 0.15 | 0.23 |

| Film Unit | Compound | 35° C. Dmax R | G | B | Dmin R | G | B |
|---|---|---|---|---|---|---|---|
| Control | — | 1.43 | 1.20 | 0.95 | 0.16 | 0.17 | 0.25 |
| VIIIA | I | 1.32 | 1.23 | 1.12 | 0.16 | 0.17 | 0.24 |
| VIIIB | II | 1.07 | 1.13 | 1.11 | 0.16 | 0.17 | 0.25 |
| VIIIC | IV | 1.65 | 1.67 | 1.62 | 0.16 | 0.17 | 0.26 |
| VIIID | IV | 1.28 | 1.24 | 1.14 | 0.16 | 0.14 | 0.17 |
| VIIIE | V | 1.24 | 1.27 | 1.24 | 0.17 | 0.14 | 0.17 |
| VIIIF | VI | 1.40 | 1.35 | 1.34 | 0.16 | 0.14 | 0.17 |
| VIIIG | VII | 1.67 | 1.78 | 1.61 | 0.14 | 0.15 | 0.25 |

It can be seen that for the film units of the invention the blue Dmax at both processing temperatures is generally higher than that for the Control and in some cases much higher. Also, the green Dmax for Film Units VIIIC, VIIIF and VIIIG is higher than that for the Control at 24° C. and at 35° C. all the Film Units except VIIIB have a green Dmax higher than that for the Control.

EXAMPLE IX

Preparation of Compound VIII

A mixture of 1-(4-acetyloximephenyl)-5-mercaptotetrazole (1.175 g, 5 mmol), sodium bicarbonate (420 mg., 5 mmol) and p-acetoxybenzyl chloride (925 mg., 5 mmol) in 30 ml of acetone was heated to boiling on a steam bath for 24 hours. The solution was vacuum filtered and the solvent was removed from the filtrate by rotary evaporation at 25° C. to give a light yellow oil. The oil was taken up in 30 ml. of methanol, the solution vacuum filtered and the filtrate allowed to stand overnight in a refrigerator. The light yellow crystals which formed were collected by filtration and dried under reduced pressure at room temperature to give 1.34 g (70% yield) of compound VIII, m.p. 126°–127° C.

$C_{18}H_{17}N_5O_3S$ requires 56.38% C, 4.47% H, 18.27% N and 8.36% S. Elemental analysis found 56.50% C, 4.57% H, 18.27% N and 8.12% S.

Although the invention has been described with respect to specific preferred embodiments, it is not intended to be limited thereto but rather those skilled in the art will recognize that variations and modifications may be made within the spirit of the invention and the scope of the appended claims.

We claim:

1. A photographic element comprising a support and at least one layer thereon containing a silver halide emulsion having associated therewith a compound represented by the formula

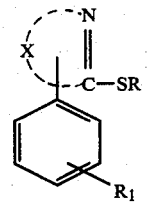

wherein X represents the nonmetallic atoms necessary to form a nucleus which completes a 5- or 6-membered heterocyclic moiety, R is a group which is cleavable in aqueous alkaline medium by hydrolysis or by quinone methide elimination or by hydrolysis followed by quinone methide elimination or by $\beta$-elimination and $R_1$ is either a group which has a pKa of from about 7 to 14 which is ionizable to an anion and wherein the silver salt of the mercaptan resulting from cleavage of —SR is more soluble in the pH range within which $R_1$ is ionized to an anion than it is below that pH range, or a precursor thereof.

2. A photographic element as defined in claim 1 wherein $R_1$ is

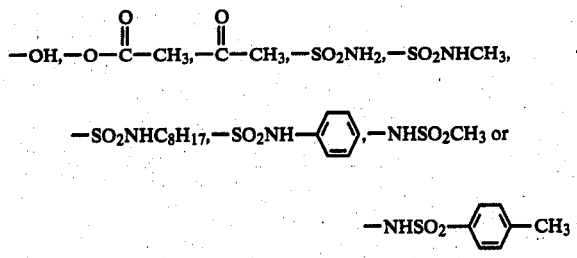

3. A photographic element as defined in claim 2 wherein $R_1$ is —OH or $—SO_2NH_2$.

4. A photographic element as defined in claim 1 wherein X represents the nonmetallic atoms necessary to complete a tetrazole moiety.

5. A photographic element as defined in claim 4 wherein said compound is represented by the formula

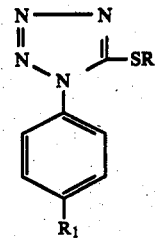

where $R_1$ is —OH 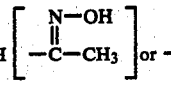 or $—SO_2NH_2$.

where $R_1$ is —OH or $—SO_2NH_2$.

* * * * *

UNITED STATES PATENT AND TRADEMARK OFFICE

CERTIFICATE OF CORRECTION

PATENT NO. : 4,355,101

DATED : October 19, 1982

INVENTOR(S) : A.C. Mehta; G.H. Nawn and L.D. Taylor

It is certified that error appears in the above-identified patent and that said Letters Patent are hereby corrected as shown below:

Column 2, under the formula at lines 27-38, insert ---FORMULA A---.

Column 4, line 28, delete "data" and insert ---date---.

Column 8, line 17, delete "$R_2$" and insert ---$R_1$---.

Column 10, line 6, delete "phtographic" and insert ---photographic---.

Column 10, line 41, delete "closets" and insert ---closest---.

Column 10, line 49, delete "hich" and insert ---which---.

Column 11, line 65, delete "fiffusible" and insert ---diffusible---.

Column 12, line 22, delete "intermedite" and insert ---intermediate---.

Column 15, line 42, delete "XV" and insert ---IV---.

Column 15, line 51, after "sodium bicarbonate (12.98g," delete "0154" and insert ---0.154---.

UNITED STATES PATENT AND TRADEMARK OFFICE

CERTIFICATE OF CORRECTION

PATENT NO. : 4,355,101 Page 2 of 2

DATED : October 19, 1982

INVENTOR(S) : A.C. Mehta; G.H. Nawn and L.D. Taylor

It is certified that error appears in the above-identified patent and that said Letters Patent are hereby corrected as shown below:

Claim 5, between the formula and the last line, delete the entire line reading "where $R_1$ is $$-OH\left[\begin{array}{c} N-OH \\ \| \\ -C-CH_3 \end{array}\right] \text{ or } -SO_2NH_2\text{"}$$

Signed and Sealed this

Twenty-first Day of February 1984

[SEAL]

Attest:

GERALD J. MOSSINGHOFF

Attesting Officer

Commissioner of Patents and Trademarks